United States Patent [19]

Ueda

[11] 4,005,743

[45] Feb. 1, 1977

[54] APPARATUS FOR THE CONTINUOUS CASTING OF METALS ESPECIALLY STEEL, AND METHOD OF CONTINUOUSLY CASTING METALS

[75] Inventor: Tetsuo Ueda, Kurashiki, Japan

[73] Assignee: Kawasaki Steel Corporation, Kobe, Japan

[22] Filed: Oct. 28, 1975

[21] Appl. No.: 626,558

[30] Foreign Application Priority Data

Nov. 1, 1974 Japan ..... 49-126328

[52] U.S. Cl. ..... 164/82; 164/150; 164/155; 164/281 H

[51] Int. Cl.[2] ..... B22D 11/10; B22D 11/16

[58] Field of Search ..... 164/281, 82, 4, 150, 164/151, 155

[56] References Cited

UNITED STATES PATENTS

| | | | |
|---|---|---|---|
| 2,305,477 | 12/1942 | Junghans | 164/82 X |
| 3,381,741 | 5/1968 | Gardner | 164/82 X |
| 3,536,122 | 10/1970 | Kloten et al. | 164/281 X |
| 3,669,181 | 6/1972 | Schrewe | 164/281 |
| 3,831,660 | 8/1974 | Hill | 164/281 X |
| 3,867,978 | 2/1975 | Johansson et al. | 164/82 |
| 3,908,735 | 9/1975 | Di Cardia | 164/281 X |

FOREIGN PATENTS OR APPLICATIONS

| | | | |
|---|---|---|---|
| 2,015,033 | 10/1971 | Germany | 164/281 |

*Primary Examiner*—Ronald J. Shore
*Attorney, Agent, or Firm*—Werner W. Kleeman

[57] ABSTRACT

A method of, and apparatus for, the continuous casting of molten metals, especially steel, wherein the molten metal is delivered through the agency of a multiplicity of pouring tubes having outlet or discharge openings inclined at a predetermined angle to the horizontal into the molten metal bath contained within a continuous casting mold. A deflecting wall or baffle means between the pouring tubes controls the flow of the molten metal in the mold.

The method of continuously casting molten metal contemplates providing baffle means between a plurality of oppositely situated pouring tubes immersed in the molten metal bath of the continuous casting mold, feeding the molten metal through the pouring tubes in the form of casting jets entering the continuous casting mold through outlet openings of the pouring tubes, and directing the outflowing metal casting jets so as to impact against the baffle means in order to control the flow of metal in the continuous casting mold.

15 Claims, 4 Drawing Figures

APPARATUS FOR THE CONTINUOUS CASTING OF METALS ESPECIALLY STEEL, AND METHOD OF CONTINUOUSLY CASTING METALS

BACKGROUND OF THE INVENTION

The present invention relates to a new and improved construction of apparatus for the continuous casting of molten metals, especially steel, the molten metal being introduced into a molten metal bath contained within a continuous casting mold by means of a multiplicity of pouring tubes having outlet or discharge openings for the outflowing metal in the form of casting jets, which outlet openings are arranged at a predetermined inclination with respect to the horizontal. The invention also relates to a new and improved method of continuously casting molten metals.

It is already known in this particular field of technology, for the purpose of preventing the formation of non-metallic inclusions in the cast product or strand, to introduce the molten metal, typically steel, flowing out of a tundish by means of pouring tubes into the molten metal bath or liquid metal pool contained within a continuous casting mold. It is conventional practice, especially when casting larger shapes or formats, for instance slabs, to deposit a flux powder upon the surface of the molten metal bath within the continuous casting mold. This flux powder serves to bond the slag particles floating to the surface of the molten bath, thereby preventing incorporation of such slag particles into the continuously cast strand. Different experiments have been carried out and become known which are concerned with the construction of the pouring tubes, their composition and arrangement. Of considerable importance is the angle of the outlet or exit opening, i.e., the direction in which the steel departs from the pouring tube and enters the molten metal bath in the continuous casting mold. If the casting jet flows directly downwardly out of the pouring tube, then the penetration depth of the outflowing steel into the continuous casting mold is considerably greater than if the outflowing casting jet departs laterally from the pouring tube. With increased penetration depth it should be appreciated that the non-metallic inclusions are also transported to a greater downward extent or penetration depth into the liquid core or pool of the cast strand, and thus, when these inclusions tend to rise they can become enclosed in the solidified front or solid-liquid interface of the casting.

In order to overcome such drawbacks the penetration depth therefore must be maintained as small as possible. However, if the deflection of the casting jet is too pronounced following its departure out of the pouring tube, then it is possible for the metal flow to break through or penetrate the protective blanket of the slag or flux layer floating on top of the molten metal bath of the mold and thus come into contact with the atmosphere. When this happens there is present the disadvantageous result that the probability of oxidation and the inclusion of slag particles increases.

A further technique which is part of the state-of-the-art relies upon introducting the steel through more than one pouring tube into the mold. Introduction of the steel into the mold occurs specifically in such a manner that the outlet or discharge openings of the pouring tubes are positioned opposite one another in order to guide the outflowing casting jet streams against one another. However, in this instance there is present the drawback that at the collision or impact zone of the casting jets there occurs a pronounced undesired turbulent flow. Furthermore, the uniformity of the flow of the steel is no longer guaranteed, likewise resulting in an increase in the number of non-metallic inclusions in the cast product. To prevent or minimize the occurrence of such non-uniformity of the steel flow, measures must be provided to insure that the throughflow rate or quantity is continually controlled and regulated. But it is extremely difficult to continuously exactly determine the quantity of throughflowing metal.

SUMMARY OF THE INVENTION

Hence, with the foregoing in mind it is a primary object of the present invention to provide a new and improved method of, and apparatus for, continuously casting metals, typically steel, in a manner not associated with the aforementioned drawbacks and limitations of the prior art.

Another object of the present invention aims at the provision of a new and improved method of, and apparatus for, continuously casting steel in a manner avoiding the drawbacks of the state-of-the-art proposals and influencing the flow of the molten metal bath within the continuous casting mold in a manner beneficially resulting in a purer cast product or casting.

Yet a further object of this invention aims at introducing the cast metal into a continuous casting mold and controlling the flow of such introduced metal and thus its action upon the molten bath within the mold in a manner such that the penetration depth of the infed metal is minimized, and the probability of so-to-speak washing out the non-metallic inclusions is increased, thereby minimizing the danger that such undesired non-metallic inclusions will be incorporated into the cast product.

It is a further noteworthy object of this invention to teach to the art novel means and techniques for the continuous casting of metals in a manner providing for a more controlled flow of the molten metal bath in the continuous casting mold, with resultant improvement in the purity of the cast product or strand.

Now in order to implement these and still further objects of the invention, which will become more readily apparent as the description proceeds, there is provided an apparatus for the continuous casting of metals, especially steel, incorporating a pluarlity of pouring tubes coacting with a continuous casting mold, each of the pouring tubes having at least one outlet or discharge opening for a casting jet, which outlet opening is at a predetermined angular inclination with respect to the horizontal. According to important aspects of the invention, a deflection wall or baffle means or equivalent structure is arranged between the pouring tubes for the purpose of controlling the flow of the molten metal in the continuous casting mold.

Due to the use of a multiplicity of pouring tubes with a deflection wall or baffle means arranged therebetween there is beneficially obtained the result that the steel casting jets or streams flowing out of the outlet or discharge openings of such pouring tubes do not collide directly with one another, and hence, there is thus achieved a relatively uniform flow in the continuous casting mold. This is particularly advantageous when casting very wide slab shapes. The flow configuration in the molten metal bath of the continuous casting mold is relatively simple and approximately symmetrical to the lengthwise axis of the casting mold. Moreover, by virtue of the forced deflection of the flow of the metal within the pouring tube and the breaking-up or so-to-speak fracture of the flow due to each casting jet or stream impinging against the baffle means or deflection wall and the therewith associated loss in energy, there is realized a reduced penetration depth of the molten metal of the casting jets entering the continuous casting mold. Therefore, in consideration of what has been stated heretofore, it should be again appreciated that the probability of incorporation of undesired non-metallic inclusions or impurities in the cast product or cast strand is reduced.

A particularly advantageous physical manifestation of the invention contemplates a construction wherein the deflection wall or baffle means is pivotably or displaceably mounted. Upon detection of a deviation of the deflection wall from a defined vertical position it is thus possible to derive therefrom an irregularity in the throughput or throughflow quantities of metal flowing through the pouring tubes and appropriate corrective measures can be initiated. In other words, the displaceably or swingingly mounted deflection wall or baffle means will positionally shift like a pendulum to one or the other side of its dead-center or vertical position, as a function of the quantity of metal flowing through each of the pouring tubes, thereby providing an indication of so-to-speak an "imbalance" in the flow of metal through the respective pouring tubes.

In accordance with a further advantageous construction of the invention, stops or impact means are provided laterally of the pivotably mounted deflection wall which delimit the pivot or swing range of such deflection wall. Operatively associated with such stops or equivalent structure may be indicator means enabling detection or determination of the magnitude of the difference of the quantities or metal streaming through the pouring tubes. This differential magnitude ca be expressed as an error signal which may be effectively employed to trigger corrective measures, such as regulating or controlling the flow through the different pouring tubes to re-establish a desired flow equilibrium through the pouring tubes, which then is manifested in terms of restoration of the deflection wall back into its essentially dead-center position i.e., essentially vertical non-deflected position.

It is preferable to select the direction of the outlet or discharge openings of the pouring tubes such that the angle which the central axis of each outlet opening encloses with regard to a horizontal is in a range which amounts to at most 15° upwards of the horizontal and at most 60° downwards of the horizontal. Stated in another way, the central axis of each outlet opening can lie within an angular range of about 75° wherein, considered with respect to the horizontal, the central axis can be inclined at an angle up to 15° upwardly of such horizontal and at an angle up to 60° downwardly of such horizontal. In this way there is insured that neither the penetration depth of the metal cast into the continuous casting mold is too great nor that the steel will be deflected upwardly in the direction of the flux layer with too great kinetic energy, which otherwise, as will be recalled, might cause too great a depth of penetration of the non-metallic inclusions into the molten bath in the mold and undesired entrapment of such inclusions in the cast strand or else undesired penetration of the protective flux powder blanket, respectively.

Not only is the invention concerned with the aforementioned apparatus aspects but, as already stated previously, deals with a novel method of continuously casting molten metals, especially steel, wherein there is provided baffle means between a plurality of oppositely situated pouring tubes immersed in the molten metal bath of a continuous casting mold. The molten metal is fed through the immersible pouring tubes in the form of casting jets which enter the continuous casting mold through outlet or discharge openings of the pouring tubes. The outflowing metal casting jets are directed so as to impact against the baffle means in order to control the flow of metal in the continuous casting mold.

BRIEF DESCRIPTION OF THE DRAWINGS

The invention will be better understood and objects other than those set forth above, will become apparent when consideration is given to the following detailed description thereof. Such description makes reference to the annexed drawing wherein.

DETAILED DESCRIPTION OF THE INVENTION

Figure 1:
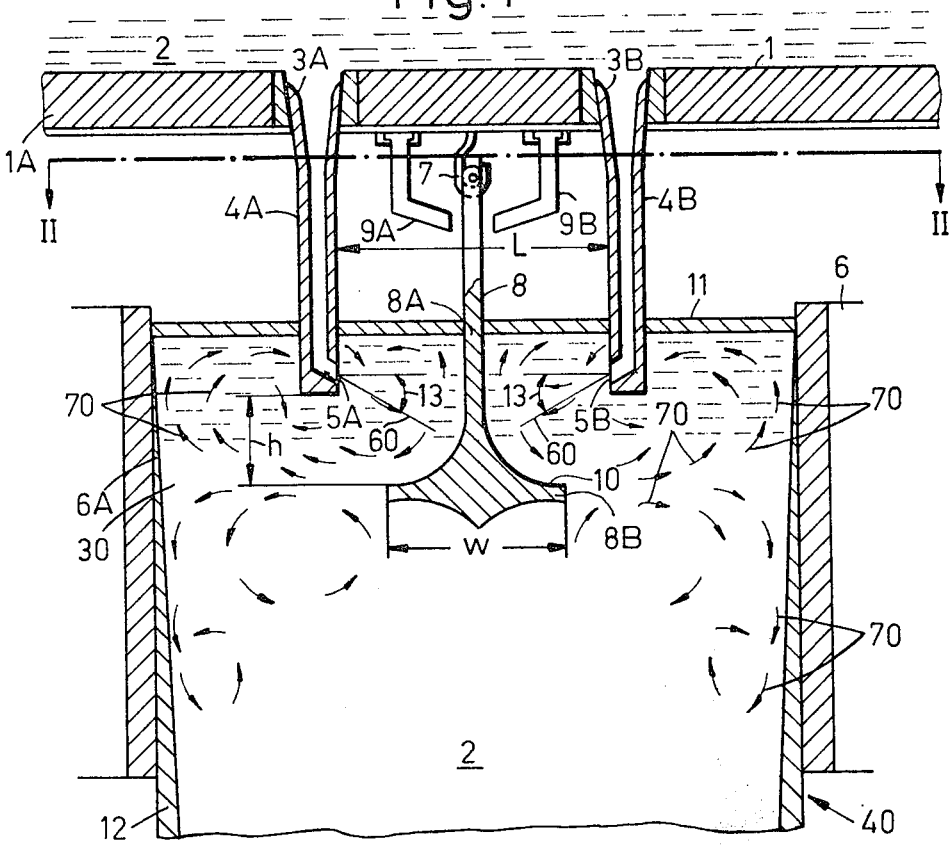
FIG. 1 is a cross-sectional view taken at the region of the floor or bottom of a tundish, depicting two pouring tubes, a continuous casting mold and the baffle means or deflection wall, of a first exemplary embodiment of the present invention.

Describing now the drawings, it is to be understood that only enough of the structure of a continuous casting installation or plant has been shown in order to preserve clarity in illustration and as required for those versed in the art to readily understand the underlying principles and concepts of the present invention. Turning attention therefore to the first exemplary embodiment depicted in FIGS. 1 and 2, it will be recognized that molten metal, typically steel 2, which is to be cast by a continuous casting process, flows from a suitable intermediate vessel, conventionally referred to in the art as a tundish 1, through outlet or pouring openings 3A and 3B provided at the floor or bottom 1A of the tundish 1 into pouring tubes 4A and 4B. Thereafter such steel flows in the form of casting jets or streams through the pouring tube-outlet or discharge openings 5A and 5B into the molten metal bath 30 contained in a continuous casting mold 6 possessing, for instance, a rectangular cross-sectional configuration, as best seen by referring to FIG. 2. The respective central axis of the outlet or discharge openings 5A and 5B of the pouring tubes 4A and 4B which are shown immersed in the liquid metal pool or bath 30 of the continuous casting mold 6 are inclined at a predetermined angle 13 with respect to the horizontal, as will be explained more fully hereinafter. Within the continuous casting mold 6 there forms a casting or strand 40 having a solidified outer layer or skin 12 and a liquid core or pool formed of the steel 2 which has not yet solidified. The top of the molten metal bath 30 is covered in conventional manner with a suitable flux powder layer and slag layer 11 forming a protective blanket covering the surface of the molten metal bath 30. At a suitable mounting or suspension device 50, for instance which may be constituted by a hook arrangement 7 attached in any appropriate manner to the tundish 1, there is suspended or mounted a baffle means or deflection wall 8 approximately at one-half the spacing L between the pouring tubes 4A and 4B and intermediate thereof, this deflection wall or baffle means 8 having a portion 8A thereof immersing into the molten meal bath 30 of the continuous casting mold 6.

Continuing, it is to be appreciated that the deflection wall 8 or equivalent structure may be advantageously suspended in such a manner at the hook arrangement or hook means 7 that it can be laterally deflected or rocked by the flow of the steel 2 emanating from the outlet openings 5A and 5B of the pouring tubes 4A and 4B respectively. The degree of such displacement, namely the deflection or pendulum-like swing to one or the other side of a dead-center position i.e., the plumb or vertical position is, however, limited by suitable stops or impact members 9A and 9B arranged laterally of the hook means or hook arrangement 7. In the examplary embodiment under discussion, the immersed deflection wall 8 approximately has the shape of an inverted T, at the lower end 8B of which there are provided curved surfaces 10 having a curvature approximately corresponding in shape to one-quarter of an arc of a circle. While the above constitutes one particularly advantageous constructional form of the deflection wall or baffle means 8, it is to be expressly understood that the invention is in no way intended to be limited thereto as other shapes of such deflection wall or baffle means 8 can be equally successfully chosen in order to obtain any desired flow of the steel. The immersion depth of this deflection wall 8 is chosen such that the outlet or exit openings 5A and 5B of the pouring tubes 4A and 4B, respectively, and which outlet openings are situated substantially opposite or in confronting relationship with respect to one another, are disposed above the lower end 8B of the deflection wall 8. The steel 2 flowing out of the pouring tubes 4A and 4B in the direction of the straight arrows 60, for instance in the form of casting jets or streams now, on the one hand, is upwardly deflected by the deflection wall 8 and, on the other hand, is deflected along the curved surfaces 10 in the direction of the inner wall 6A of the continuous casting mold 6, the stream of steel 2 again being upwardly and downwardly divided at such inner wall 6A of the continuous casting mold 6. The obtained flow configuration has been indicated in FIG. 1 schematically by the flow arrows generally indicated by reference character 70.

Due to the arrangement of the deflection wall or baffle means 8 between the outlet openings 5A and 5B of the pouring tubes 4A and 4B, respectively, the outflowing casting jets or streams do not collide with one another, and additionally, the molten metal flow in the lengthwise direction of the continuously cast strand 40 is braked and deflected. Consequently, the metal, here the steel 2 flows slowly downward with the withdrawn continuously cast strand 40 while a solidified layer or skin 12 forms at the inside of the continuous casting mold 6. Due to the partial destruction of the kinetic energy of the inflowing steel there is also reduced the penetration depth thereof and equally that of the present non-metallic inclusions or particles, resulting in a purer cast product with less inclusions. Due to the deflection of the steel as described above, there is additionally enhanced the deposit and take-up of the upwardly conveyed non-metallic particles at the covering blanket of the slag layer 11.

Figure 2:
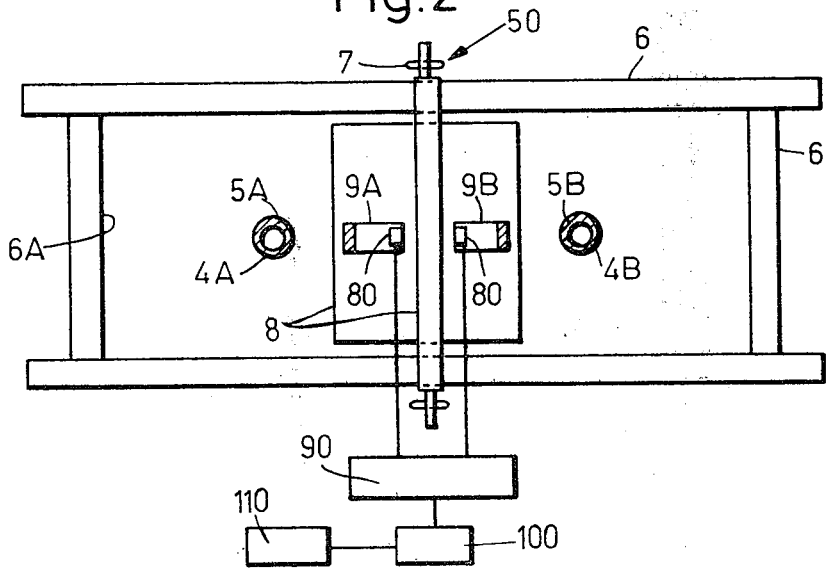
FIG. 2 is a cross-sectional view of the arrangement of FIG. 1, taken substantially along the lines II—II thereof.

As already mentioned heretofore the deflection wall or baffle means 8 is limited in its deflection or swing by the stops or impact members 9A and 9B in such a manner that it only can pivot within a very small range. When both laterally outflowing quantities of metal departing from the exit or outlet openings 5A and 5B of the pouring tubes 4A and 4B, respectively, are of the same magnitude, then the deflection wall or baffle means 8 does not appreciably move, rather remains essentially stationary approximately in its central position i.e., the vertical or dead-center position. However, if the uniformity of the flow rates of the casting streams or jets flowing out of the pouring tubes 4A and 4B no longer is maintained, then the deflection wall 8 is rocked or pivoted towards the side of lesser flow, so that such deflection wall 8 assumes an inclined position with respect to the vertical. Hence, the angle of inclination of the deflection wall 8 could be beneficially employed as an indication of the throughflow rates, i.e., if desired, there can be ascertained whether there is present a uniform or constant flow through both of the pouring tubes 4A and 4B. For instance, as schematically shown in FIG. 2 through the provision of pressure indicator devices 80 at the stops or impact members 9A and 9B it is possible to determine the difference of the throughflow rates prevailing at both of the pouring tubes 4A and 4B as a function of the pressure differential which can be ascertained at a suitable pressure differential detector or sensor 90 and in consequence thereof an appropriate regulation of the metal flow rates or quantities through the pouring tubes 4A and 4B can be initiated with the aid of a suitable control 100 and conventional flow regulating means, for instance by adjusting the position of stoppers or equivalent structure, generally indicated by reference character 110, in order to thus regulate the flow of metal into the respective pouring tubes 4A and 4B. However, the deflection wall 8 or equivalent structure also could be fixed in its central or dead-center position with the aid of stops or equivalent means in the event there is not present the necessity of insuring for a uniform flow through both of the pouring tubes 4A and 4B. Conceptually, then, the stops 9A and 9B could be extended at their free ends so as to fix in position the deflection wall 8 or the suspension means 50 could provide a fixed mounting of such deflection wall, or other appropriate measures to achieve such immobility of the deflection wall could be provided.

Finally, it was previously indicated that the outlet or exit openings 5A and 5B of the pouring tubes 4A and 4B have the center line thereof arranged at an inclination with respect to the horizontal. It has been found that the inclination of the respective center line or axis of the outlet openings 5A and 5B should not exceed an angle with respect to the horizontal of at most 15° upwardly from the horizontal and at most 60° downwardly from the horizontal.

Reference will now be made to the variant embodiment of the present invention depicted in FIGS. 3 and 4 in conjunction with two pouring tubes, wherein it will be recognized that as a matter of convenience the same or analogous components have been generally designated by the same reference characters as employed with respect to the previously described embodiment of FIGS. 1 and 2. It will be seen that the deflection wall or baffle means 8, in this instance, is constructed as a substantially flat plate 8C, the thickness of which increases when viewed in the direction of travel of the continuous cast strand 40. This plate-like deflection wall 8 cooperates with two pouring tubes 4A and 4B, which, in this case, each have two laterally directed discharge or outlet openings 5A, 5C and 5B, 5D respectively. After flowing through the pouring tubes 4A and 4B the melt departs out of the discharge or outlet openings 5A, 5C and 5B, 5D of the pouring tubes 4A and 4B, respectively, approximately in the direction of the straight arrow 60, and enters the molten metal bath 30 with a downwardly directed component. Thereafter, the casting jets or streams emanating from the openings 5A and 5B of the pouring tubes 4A and 4B which confront the deflection wall 8 —after moving through a certain distance— impact against such deflection wall 8 and thus are deflected both upwardly in the direction of the flux powder or slag layer 11 as well as also downwardly. The casting jets or streams flowing out of the openings 5C and 5D of the pouring tubes 4A and 4B, respectively, arrive at the inner wall 6A of the continuous casting mold 6 and at the outer skin or layer 12 which has already formed at the continuously cast strand 40 and are again divided into upwardly and downwardly directed flow streams. The flow streams or flow obtained in the molten metal bath 30 with this embodiment have been schematically generally indicated by the arrows 70.

With this exemplary embodiment the penetration depth of the introduced steel, in contrast to the penetration depth of the exemplary embodiment of FIGS. 1 and 2, is somewhat greater, however by virtue of the intentional prevention of the collision of the casting jets or streams emanating from both of the pouring tubes 4A ad 4B, which feature is also present with this embodiment, there is not formed any undesired turbulent flow. Just as was the case for the preceding discussed exemplary embodiment, the flow rate or quantities of metal flowing through the pouring tubes can be regulated as a function of the angular rocking or swing of the deflection wall 8 if the same is mounted to be pivotable. In order to simplify the showing of the drawings of FIGS. 3 and 4 in this case the control circuit previously shown schematically with regard to the arrangement of FIGS. 1 and 2 has been omitted from the showing of FIGS. 3 and 4, but may be of the same or equivalent structure.

Figure 3:
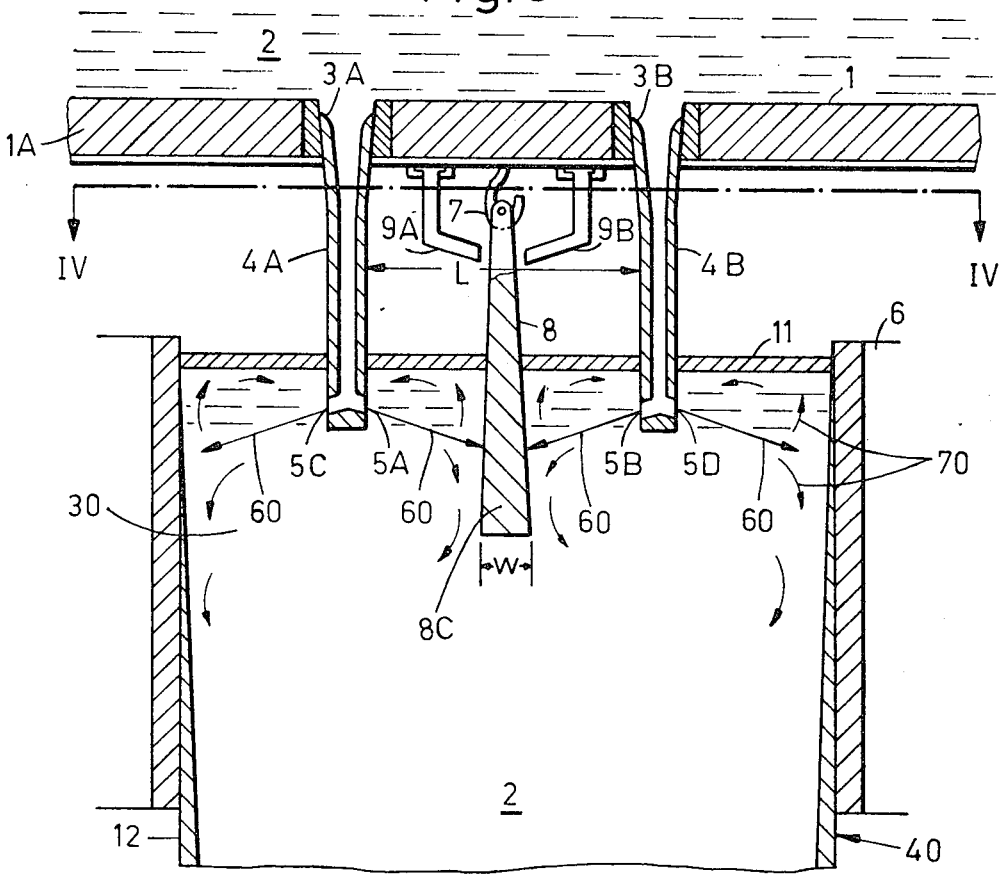
FIG. 3 is a cross-sectional view taken at the region of the floor or bottom of a tundish, depicting two pouring tubes, a continuous casting mold and a further construction of baffle means or deflection wall, of a second exemplary embodiment of the present invention.
Figure 4:
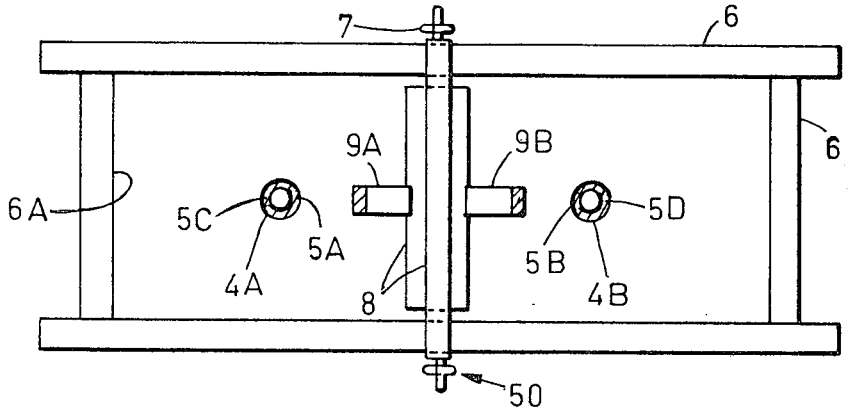
FIG. 4 is a cross-sectional view of the arrangement of FIG. 3, taken substantially along the line IV—IV thereof.

The penetration depth of the metal flow can be influenced by carrying out different contructions of the deflection wall or baffle means 8, for instance by appropriately selecting the curvature of the wall surfaces as taught with the first exemplary embodiment of FIGS. 1 and 2 or by selecting an appropriate angle or taper of the wall surfaces with respect to the vertical according to the exemplary embodiment of FIGS. 3 and 4, which, for instance, can be achieved by varying the thickness of the plate 8C constituting the deflection wall 8 as discussed above. It will be recognized that in the embodiment of FIGS. 3 and 4 this deflection wall 8 has the plate 8C thereof enlarging in thickness or diverging from its upper end in the direction of its lower end immersed in the molten metal bath 30 of the continuous casting mold 6.

The deflection wall 8 should be formed of suitable high-grade refractory material, for instance alumina or molten $SiO_2$. Further it is to be clearly understood that the concepts of the invention are in no way limited to the combination of two pouring tubes each having an outlet opening and a deflection wall in the form of an inverted T-shaped configuration, as shown in the arrangement of FIG. 1, or the combination of two pouring tubes each having two downwardly directed outlets or exit openings and a deflection wall in the form of a flat plate, as shown in the embodiment of FIGS. 3 and 4, rather there can be beneficially employed other combinations of pouring tubes and deflection walls or baffles.

Both of the pouring tubes 4A and 4B or equivalent structure are arranged at the spacing L from one another. The width $w$ of the deflection wall 8 at the lower end advantageously should be smaller than the spacing or distance L in order to render possible an exchange or replacement of this wall during casting. The vertical distance or spacing $h$ between the ends of the pouring tubes 4A and 4B and the curved surfaces of the deflection wall 8 should be selected in conjunction with the angles 13 of the outlet or exit openings. This distance $h$ however must be selected such that the casting jets or streams of the molten metal impinge against the deflection wall or baffle means 8. As explained above, and as applicable to the various embodiments disclosed herein, the angle 13 advantageously should lie in a range between at most 15° upwardly with respect to the horizontal and at most 60° downwardly with respect to the horizontal.

Having now had the benefit of the above-discussion of the exemplary embodiments of apparatus, there will be further explained the invention in conjunction with two numerical examples.

EXAMPLE 1

During casting of a slab with a cross-sectional dimension of 2100 millimeters width and 260 millimeters thickness by means of an arc-type continuous casting mold or curve mold, there was utilized a deflection wall or baffle means of the type shown in FIGS. 1 and 2 in conjunction with two pouring tubes each having outlet or exit openings directed downwardly at an angle of 25° . The diameter of such outlet openings amounted to 50 millimeters. The penetration depth of the molten steel into the metal bath 30 amounted to less than one-third of the penetration depth obtained with a casting installation not equipped with the apparatus of this development. There was determined an inclusion content of only approximately one-quarter of that which is present in a cast slab which has been cast with only one pouring tube with outlet openings of 50 millimeters diameter and which outlet openings were similarly downwardly inclined or directed at an angle of 25°.

EXAMPLE 2

During casting a slab of the dimensions of 2100 millimeters by 260 millimeters, there were used two pouring tubes in conjunction with a plate-shaped deflection wall of the type shown in FIGS. 3 and 4. The diameter of the outlet openings of the pouring tubes amounted to 40 millimeters, the angle enclosed between the respective central axis of the outlet openings and a horizontal amounted to 15° in the downward direction from the horizontal. In contrast to the use of a single pouring tube with two outlet openings directed downwardly at an angle of 25° and having a diameter of 50 millimeters there was realized a penetration depth which was less by one-half and an inclusion content which were present when using a prior art single pouring tube.

The above demonstrates the clearly efficacious results which can be obtained when using apparatus designed according to the principles of the present invention for the continuous casting of metals. Obviously, further modifications of the disclosed embodiments are within the contemplation of the invention and will readily suggest themselves to those skilled in the art.

While there is shown and described pesent preferred embodiments of the invention, it is to be distinctly understood that the invention is not limited thereto, but may be otherwise variously embodied and practiced within the scope of the following claims.

Accordingly, what is claimed is:

1. An apparatus for the continuous casting of molten metal, especially steel, comprising a continuous casting mold, a multiplicity of pouring tubes each having at least one outlet opening inclined at a predetermined angle with respect to a horizontal for delivering molten metal into a molten metal bath contained within the continuous casting mold, and means arranged between the pouring tubes to prevent collision of the molten metal delivered through the outlet openings of the pouring tubes and for controlling the flow of the molten metal in the continuous casting mold.

2. The apparatus as defined in claim 1, wherein said means arranged between the pouring tubes comprises a deflection wall.

3. The apparatus as defined in claim 2, including means for pivotably mounting said deflection wall.

4. The apparatus as defined in claim 3, further including lateral stop means for limiting the degree of pivoting of the deflection wall.

5. The apparatus as defined in claim 1, wherein the outlet opening of each pouring tube has a central axis, said central axis of each outlet opening being arranged at said predetermined angle with regard to the horizontal which is in a range of at most 15° upwards of the horizontal and at most 60° downwards of the horizontal.

6. The apparatus as defined in claim 1, wherein each pouring tube has at least two outlet openings for delivering therefrom the molten metal in opposite lateral directions with respect to the lengthwise axis of the pouring tube.

7. An apparatus for the continuous casting of molten metal, especially steel, comprising a continuous casting mold, a multiplicity of pouring tubes each having at least one outlet opening inclined at a predetermined angle with respect to a horizontal for delivering molten metal into a molten metal bath contained within the continuous casting mold, a deflection wall arranged between the pouring tubes for controlling the flow of the molten metal in the continuous casting mold, means for pivotably mounting said deflection wall, and means for detecting the degree of pivoting of said deflection wall.

8. An apparatus for the continuous casting of molten metal, especially steel, comprising a continuous casting mold, at least one pair of immersible pouring means each having at least one outlet opening, each outlet opening delivering molten metal in the form of a casting jet into a molten metal bath contained within the continuous casting mold, and means interposed between and in spaced relation from said immersible pouring means for preventing collision of the molten metal delivered through the outlet opening of the pouring tubes and for controlling the flow of the molten metal at least at the region of entry of the casting jets into the molten metal bath in the continuous casting mold.

9. A method of casting molten metal into a continuous casting mold, especially for casting steel, comprising the steps of:

a. providing a continuous casting mold;

b. providing a plurality of spaced pouring tubes for the infeed of molten metal into the continuous casting mold, each pouring tube having at least one outlet opening for the infeed of the molten metal into the continuous casting mold;

c. providing baffle means between the plurality of spaced pouring tubes;

d. feeding molten metal through the pouring tubes and delivering the molten metal in the form of casting jets into the continuous casting mold through the outlet openings of the pouring tubes; and e. directing the outflowing metal casting jets so as to impact against the baffle means in order to prevent collision of the outflowing metal casting jets and to control the flow of metal in the continuous casting mold.

10. The method as defined in claim 9, including the step of providing the outlet openings of the pouring tubes arranged at a predetermined angle of inclination with respect to a horizontal.

11. The method as defined in claim 10, including the step of selecting the angle of inclination of a central axis of each outlet opening of each pouring tube so as to at most amount to 15° upwardly from the horizontal and at most 60° downwardly from the horizontal.

12. The method as defined in claim 9, including the step of mounting the baffle means so as to be pivotable.

13. The method as defined in claim 9, including the step of utilizing a stationary baffle means.

14. A method of casting molten metal into a continuous casting mold, especially for casting steel, comprising the steps of: providing a continuous casting mold; providing a plurality of spaced pouring tubes for the infeed of molten metal into the continuous casting mold, each pouring tube having at least one outlet opening for the infeed of the molten metal into the continuous casting mold; providing baffle means between the plurality of spaced pouring tubes; feeding molten metal through the pouring tubes and delivering the molten metal in the form of casting jets into the continuous casting mold through the outlet openings of the pouring tubes; directing the outflowing metal casting jets so as to impact against the baffle means in order to control the flow of metal in the continuous casting mold; mounting the baffle means so as to be pivotable; detecting the degree of pivoting of the baffle means upon impingement by the casting jets emanating from the pouring tubes; obtaining an error signal; and utilizing said error signal to regulate the flow of molten metal through each of the pouring tubes.

15. A method of casting molten metal into a continuous casting mold, especially for the casting of steel, comprising the steps of:

a. providing a continuous casting mold;

b. providing a plurality of spaced apart immersible pouring means for the infeed of molten metal into the continuous casting mold;

c. providing molten metal flow control means between the plurality of spaced immersible pouring means;

d. feeding molten metal through the immersible pouring means and into the continuous casting mold; and e. delivering the outflowing metal in the direction of the molten metal flow control means in order to prevent collision of the outflowing metal and to control the flow of metal in the continuous casting mold at least at the region of the upper portion of the continuous casting mold.

* * * * *